US011396723B2

(12) United States Patent
Ohyagi et al.

(10) Patent No.: US 11,396,723 B2
(45) Date of Patent: Jul. 26, 2022

(54) WASHING MACHINE AND CONTROL METHOD OF THE SAME

(71) Applicant: Samsung Electronics Co., Ltd, Suwon-si (KR)

(72) Inventors: Atsushi Ohyagi, Kanagawa (JP); Hiroki Takita, Kanagawa (JP); Nobuhiko Shinohara, Kanagawa (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 326 days.

(21) Appl. No.: 16/230,622

(22) Filed: Dec. 21, 2018

(65) Prior Publication Data

US 2019/0194855 A1 Jun. 27, 2019

(30) Foreign Application Priority Data

Dec. 22, 2017 (JP) ..... JP2017-246311
Sep. 5, 2018 (KR) ..... 10-2018-0105965

(51) Int. Cl.
*D06F 33/76* (2020.01)
*D06F 23/04* (2006.01)
(Continued)

(52) U.S. Cl.
CPC ..... *D06F 33/76* (2020.02); *D06F 23/04* (2013.01); *D06F 33/48* (2020.02); *D06F 37/12* (2013.01);
(Continued)

(58) Field of Classification Search
CPC ..... D06F 18/00; D06F 25/00; D06F 33/00; D06F 33/30–76; D06F 34/00–34;
(Continued)

(56) References Cited

U.S. PATENT DOCUMENTS 9,236,818 B2 1/2016 Okamoto
2005/0115006 A1* 6/2005 Lee ..... D06F 33/48 8/158
(Continued)

FOREIGN PATENT DOCUMENTS

EP 2520700 A1 11/2012
EP 2597187 A1 5/2013
(Continued)

OTHER PUBLICATIONS

ISA/KR, "International Search Report," Application No. PCT/KR2018/016276, dated Apr. 8, 2019, 7 pages.
(Continued)

*Primary Examiner* — David G Cormier

(57) ABSTRACT

Disclosed herein is a washing machine capable of appropriately identifying the presence or absence of waterproof clothing. The washing machine includes a cabinet, an outer tub elastically supported on the inside of the cabinet, an inner tub rotatably provided inside of the water tub, a motor configured to rotate the inner tub, a vibration sensor provided in the outer tub, a rotation sensor provided in the motor; and a at least one processor electrically connected to the vibration sensor, the rotation sensor and the motor and configured to control a rotation speed of the motor based on a vibration of the outer tub detected by the vibration sensor and a rotation of the motor detected by the rotation sensor.

19 Claims, 10 Drawing Sheets

(51) Int. Cl.

| | |
|---|---|
| ***D06F 37/12*** | (2006.01) |
| ***D06F 33/48*** | (2020.01) |
| *D06F 37/30* | (2020.01) |
| *D06F 39/08* | (2006.01) |
| *D06F 103/18* | (2020.01) |
| *D06F 103/24* | (2020.01) |
| *D06F 103/26* | (2020.01) |
| *D06F 103/46* | (2020.01) |
| *D06F 105/46* | (2020.01) |
| *D06F 34/16* | (2020.01) |

(52) U.S. Cl.
CPC ..... *D06F 34/16* (2020.02); *D06F 37/304* (2013.01); *D06F 39/083* (2013.01); *D06F 2103/18* (2020.02); *D06F 2103/24* (2020.02); *D06F 2103/26* (2020.02); *D06F 2103/46* (2020.02); *D06F 2105/46* (2020.02)

(58) Field of Classification Search
CPC ..... D06F 35/00–008; D06F 37/00; D06F 37/203; D06F 37/22; D06F 37/225; D06F 37/24; D06F 37/245; D06F 37/304; D06F 39/00; D06F 58/00–30; D06F 2101/00–20; D06F 2103/00–70; D06F 2222/00; D06F 2105/28; D06F 2105/40; D06F 2105/46; D06F 2105/48; D06F 2105/50–62; D06F 2202/00; D06F 2202/10; D06F 2202/12; D06F 2204/00–10
See application file for complete search history.

(56) References Cited

U.S. PATENT DOCUMENTS

| | | | | |
|---|---|---|---|---|
| 2008/0178398 | A1* | 7/2008 | Darby | D06F 37/145 8/159 |
| 2012/0017648 | A1 | 1/2012 | Kwon et al. | |
| 2012/0278996 | A1 | 11/2012 | Park et al. | |

FOREIGN PATENT DOCUMENTS

| | | | | |
|---|---|---|---|---|
| JP | 2003174792 | A | 6/2003 | |
| JP | 2011160845 | A | 8/2011 | |
| JP | 2012170686 | A | 9/2012 | |
| JP | 2013192862 | A | 9/2013 | |
| JP | 5380320 | B2 | 1/2014 | |
| JP | 2014131592 | A | 7/2014 | |
| JP | 2014155273 | A | 8/2014 | |
| JP | 5784532 | B2 | 9/2015 | |
| JP | 2017028949 | A | 2/2017 | |
| KR | 10-2012-0124769 | A | 11/2012 | |
| WO | WO-2010026246 | A1 * | 3/2010 | D06F 34/18 |

OTHER PUBLICATIONS

Supplementary European Search Report dated Sep. 22, 2020 in connection with European Patent Application No. 18 89 2427, 8 pages.
Notice of Reasons for Refusal dated Dec. 21, 2021, in connection with Japanese Application No. 2017-246311, 9 pages.

* cited by examiner

WASHING MACHINE AND CONTROL METHOD OF THE SAME

CROSS-REFERENCE TO RELATED APPLICATIONS

This application is based on and claims priority under 35 U.S.C. § 119 to Japan Patent Application No. 2017-246311 filed on Dec. 22, 2017 in the Japan Intellectual Property Office, and Korean Patent Application No. 10-2018-0105965 filed on Sep. 5, 2018 in the Korean Intellectual Property Office, the disclosures of which are incorporated by reference herein in its entirety.

BACKGROUND

1. Field

Embodiments of the present disclosure relate to a washing machine and a control method of the washing machine.

2. Description of Related Art

An automatic washing machine for automatically performing washing, rinsing, and dehydrating processes has been known. In such a washing machine, it is difficult to dehydrate some laundry and during dehydrating some laundry, an abnormal vibration may occur, wherein the some laundry represents laundry which hardly allows water to pass through or which allows a little water to pass through despite of allowing water to pass through (herein, it is generally referred to as waterproof clothing), and the waterproof clothing includes clothing which is waterproofed, or water impermeable (e.g., raincoats or nylon bed covers). Therefore, the washing machine provides a notification that a user should not dehydrating the waterproof clothing.

Particularly, when the waterproof clothing is mixed with the laundry, water may be wrapped by the waterproof clothing upon washing or rinsing. In this state, when rotation speed of a washing/dehydrating tub reaches a high rotation range such as 1000 rpm, upon a dehydrating process, water remaining in the waterproof clothing may be suddenly moved and thus an abnormal vibration may occur and the water tub may largely swing.

Therefore, a technique for predicting and preventing abnormal vibrations, which may occur when the waterproof clothing is mixed with laundry and dewatered, has been studied, and various methods have been proposed today.

SUMMARY

Therefore, it is an aspect of the present disclosure to provide a washing machine capable of appropriately identifying the presence or absence of waterproof clothing, and a control method thereof.

Additional aspects of the present disclosure will be set forth in part in the description which follows and may be learned by practice of the present disclosure.

In accordance with an aspect of the disclosure, a washing machine includes a cabinet, an outer tub elastically supported on the inside of the cabinet, an inner tub rotatably provided inside of the outer tub, a motor configured to rotate the inner tub, a vibration sensor provided in the outer tub, a rotation sensor provided in the motor; and at least one processor electrically connected to the vibration sensor, the rotation sensor and the motor and configured to control a rotation speed of the motor based on a vibration of the outer tub detected by the vibration sensor and a rotation of the motor detected by the rotation sensor.

The at least one processor may receive a vibration signal indicating the vibration of the outer tub, from the vibration sensor and a rotation signal indicating the rotation of the motor from the rotation sensor, and control the rotation speed of the motor based on a phase difference between the vibration signal and the rotation signal.

The at least one processor may rotate the motor at a first rotation speed when a variation of the phase difference is less than a reference value, and rotate the motor at a second rotation speed, which is less than the first rotation speed, when the variation of the phase difference is equal to or greater than the reference value.

The at least one processor may perform pre-spin accelerating the motor to a first dehydrating speed, and main spin accelerating the motor to a second dehydrating speed that is greater than the first rotation speed, at a dehydrating operation.

The at least one processor may receive a first vibration signal from the vibration sensor and a first rotation signal from the rotation sensor in response to a case in which the rotation speed of the motor reaches a detection speed during the pre-spin, and receive a second vibration signal from the vibration sensor and a second rotation signal from the rotation sensor in response to a case in which the rotation speed of the motor reaches a detection speed during the main spin.

The at least one processor may control the rotation speed of the motor based on a first phase difference indicating a phase difference between the first vibration signal and the first rotation signal, and a second phase difference indicating a phase difference between the second vibration signal and the second rotation signal.

The at least one processor may rotate the motor at the first rotation speed when a difference between the first phase difference and the second phase difference is less than a reference value, and rotate the motor at the second rotation speed, which is less than the first rotation speed, when the difference between the first phase difference and the second phase difference is equal to or greater than the reference value.

In accordance with another aspect of the disclosure, a control method of a washing machine including a cabinet, an outer tub elastically supported on the inside of the cabinet, an inner tub rotatably provided inside of the outer tub, and a motor configured to rotate the inner tub, the control method includes detecting a vibration of the outer tub by a vibration sensor provided in the outer tub, detecting a rotation of the motor by a rotation sensor provided in the motor, and controlling a rotation speed of the motor based on the vibration of the outer tub and the rotation of the motor.

The control of the rotation speed of the motor based on the vibration of the outer tub and the rotation of the motor may include controlling the rotation speed of the motor based on a phase difference between a vibration signal indicating the vibration of the outer tub and a rotation signal indicating the rotation of the motor.

The control of the rotation speed of the motor based on a phase difference may include rotating the motor at a first rotation speed when a variation of the phase difference is less than a reference value, and rotating the motor at a second rotation speed, which is less than the first rotation speed, when the variation of the phase difference is less than or greater than the reference value.

The control method may further include performing pre-spin accelerating the motor to a first dehydrating speed, and main spin accelerating the motor to a second dehydrating speed that is greater than the first rotation speed, at a dehydrating operation.

The control method may further include obtaining a first vibration signal indicating the vibration of the outer and a first rotation signal indicating the rotation of the motor, in response to a case in which the rotation speed of the motor reaches a detection speed during the pre-spin, and obtaining a second vibration signal indicating the vibration of the outer and a second rotation signal indicating the rotation of the motor, in response to a case in which the rotation speed of the motor reaches a detection speed during the main spin.

The control of the rotation speed of the motor based on the vibration of the outer tub and the rotation of the motor may include controlling the rotation speed of the motor based on a first phase difference indicating a phase difference between the first vibration signal and the first rotation signal and a second phase difference indicating a phase difference between the second vibration signal and the second rotation signal.

The control of the rotation speed of the motor based on the first phase difference and the second phase difference may include rotating the motor at the first rotation speed when a difference between the first phase difference and the second phase difference is less than a reference value, and rotating the motor at the second rotation speed when the difference between the first phase difference and the second phase difference is less than or greater than the reference value.

In accordance with another aspect of the disclosure, a washing machine provided with a rotary tub configured to accommodate laundry, a water tub in which the rotary tub is placed and a driver motor configured to rotate the rotary tub, and configured to perform a dehydrating process of laundry upon the rotation of the rotary tub, the washing machine includes a vibration sensor configured to detect an acceleration in a horizontal direction caused by a vibration of the water tub, a motor sensor configured to detect a rotation signal of the drive motor, and at least one processor configured to control a rotation operation of the drive motor. At the start of the dehydrating process, the at least one processor controls an operation of the drive motor to perform two times of acceleration operation in which the rotation of the rotary tub is accelerated at a low rotation range that is lower than the predetermined revolutions. The vibration sensor and the motor sensor detect the acceleration and the rotation signal at the two times of acceleration operation.

The vibration sensor and the motor sensor may detect the acceleration and the rotation signal at a predetermined same revolutions range of the two times of acceleration operation.

The washing machine may further include a waterproof clothing identifier configured to identify whether the waterproof clothing is present in the laundry, based on a detection value of the vibration sensor and a detection value of the motor sensor.

The waterproof clothing identifier may calculate a phase difference between a phase of the acceleration detected by the vibration sensor and a phase of the rotation signal detected by the motor sensor.

The waterproof clothing identifier may identify the presence or absence of the waterproof clothing by comparing an amount of variation between two phase differences, which is calculated every acceleration operation, with a predetermined reference value.

When the waterproof clothing identifier identifies that the waterproof clothing is present, at least one processor may control an operation of the drive motor so that the rotary tub is rotated at the predetermined revolutions or less, at the dehydrating process.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
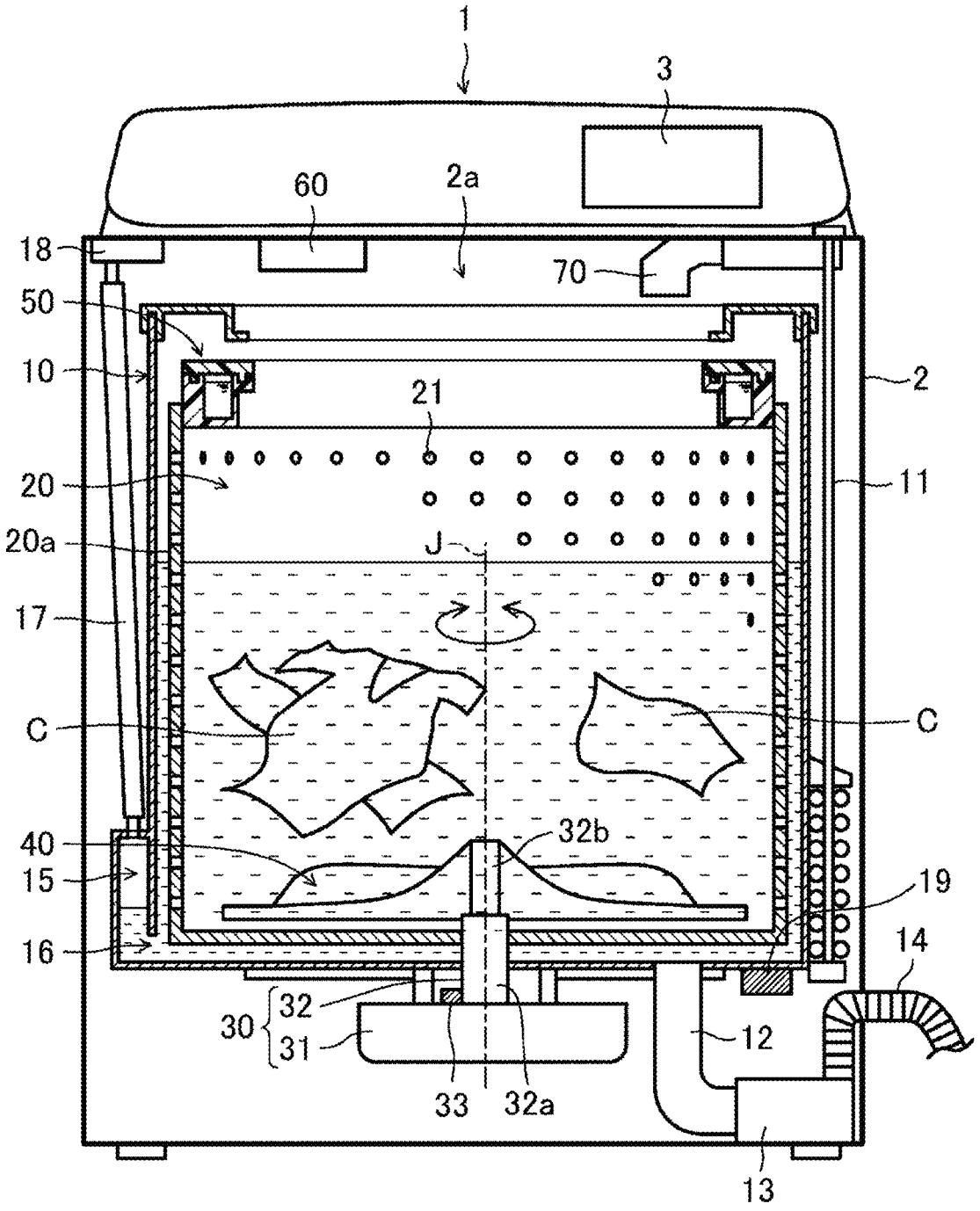
FIG. 1 is a schematic longitudinal sectional view illustrating a configuration of a washing machine according to an embodiment.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, various embodiments will now be described more fully hereinafter with reference to the accompanying drawings. The various embodiments may, however, be embodied in many different forms and should not be construed as being limited to the embodiments set forth herein. These embodiments are provided so that this disclosure will be thorough and complete and will fully convey the various embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the various embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Embodiments described in the present disclosure and configurations shown in the drawings are merely examples of the embodiments of the present disclosure, and may be modified in various different ways at the time of filing of the present application to replace the embodiments and drawings of the present disclosure.

Figure 2:
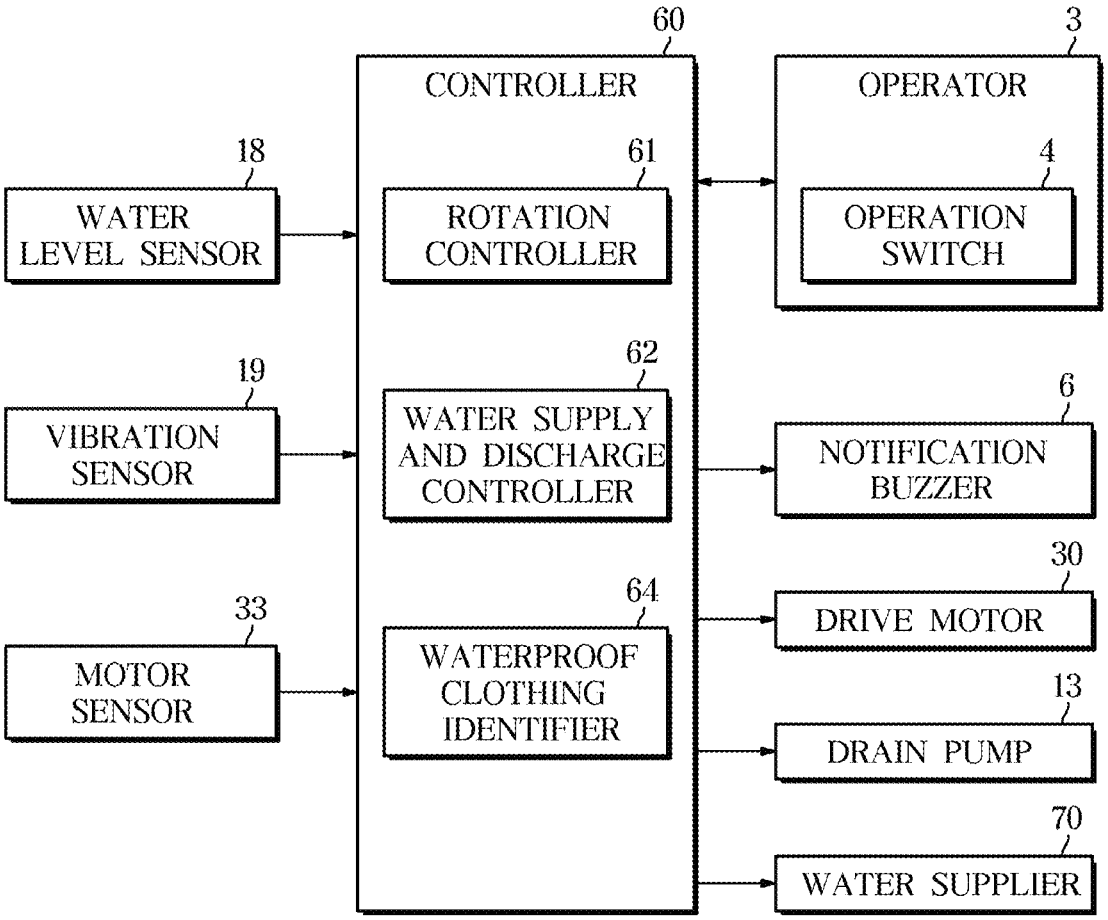
FIG. 2 is a block diagram illustrating a relationship between a controller and each devices contained in the washing machine according to an embodiment.

FIG. 1 is a schematic longitudinal sectional view illustrating a configuration of a washing machine according to an embodiment. FIG. 2 is a block diagram illustrating a relationship between a controller and each devices contained in the washing machine according to an embodiment.

As illustrated in FIG. 1, a washing machine 1 is a top load washing machine. An inlet 2*a* is provided in an upper portion of a rectangular box-shaped housing 2. Laundry C is put in and out through the inlet 2*a*.

An operator 3 is provided at the rear of the inlet 2*a*. A user operates the operator 3 so that the washing machine 1 automatically and continuously performs the processes of "water supply", "washing", "rinsing", and "dehydrating".

A water tub 10, a rotary tub 20, a drive motor 30, a pulsator 40, a balancer 50, and a controller 60 are provided inside the housing 2.

The water tub 10 is configured by a cylindrical container that is opened to the upper side and has a bottom, and the water tub 10 is provided in the central portion of the housing. In order to move in the housing 2, the water tub 10 is elastically supported on the housing 2 in a suspended state by a plurality of suspensions 11.

The rotary tub 20 is formed by a cylindrical container that is opened to the upper side and has a bottom, and the rotary tub 20 is smaller than the water tub 10. The rotary tub 20 is placed inside of the water tub 10 while the center of the rotary tub 20 and the water tub 10 are aligned with a longitudinal axis J.

In a peripheral wall 20*a* of the rotary tub 20, a plurality of drain holes 21 passing through the inside and outside of the peripheral wall 20*a* is formed all over the circumference. At the bottom of the rotary tub 20, the pulsator 40 is provided. The pulsator 40 is formed by a disk-shaped member having a plurality of blade-shaped projections radially provided on its upper surface. The laundry C is put into the rotary tub 20 and all the processes such as washing and dehydrating are performed while the laundry C is placed in the rotary tub 20.

The rotary tub 20 is rotatably supported on the water tub 10. The rotary tub 20 is rotationally driven around the longitudinal axis J by the drive motor 30 provided on the back side of the bottom surface of the water tub 10. Particularly, the drive motor 30 includes a motor main body 31, and a power transmission device 32. The power transmission device 32 has a first rotating shaft 32*a* and a second rotating shaft 32*b* in which its center is aligned with the longitudinal axis J, respectively.

The first rotating shaft 32*a* penetrates the bottom wall of the water tub 10 and is mounted on the bottom wall of the rotary tub 20. The second rotating shaft 32*b* protrudes into the inside of the rotary tub 20 by passing through the bottom wall of the water tub 10 and the bottom wall of the rotary tub 20. The protruding end of the second rotating shaft 32*b* is mounted on the center of the pulsator 40.

The power transmission device 32 switches the rotation directions of the first rotating shaft 32*a* and the second rotating shaft 32*b* in accordance with each process. As a result, the first rotating shaft 32*a* and the second rotating shaft 32*b* may rotate in the forward, reverse, and forward/reverse directions in a state in which the first rotating shaft 32*a* and the second rotating shaft 32*b* are independent from each other or integral with each other. For example, in the washing process and the rinsing process, only the second rotating shaft 32*b* is driven. Therefore, the rotary tub 20 does not rotate and the pulsator 40 rotates in the forward and reverse direction at a predetermined period. In the dehydrating process, the first rotating shaft 32*a* and the second rotating shaft 32*b* are integrally driven with each other, and the rotary tub 20 and the pulsator 40 integrally rotate at a high speed in the predetermined direction.

The balancer 50 is an annular member and is provided at the upper end of the peripheral wall 20*a* of the rotary tub 20. In the inside of the balancer 50, a liquid having a high specific gravity such as brine or a plurality of balls is movably enclosed. By the balancer 50, it is possible to offset the unbalance caused by uneven distribution of the laundry C at the time of high-speed rotation of the rotary tub 20 and thus it is possible to prevent the vibration at the dehydrating process.

A drain hose 12 and a drain pump 13 are installed under the water tub 10 in the housing 2. One end of the drain hose 12 is connected to the bottom wall of the water tub 10 and the other end of the drain hose 12 is connected to an inlet of the drain pump 13. An outer hose 14 of the washing machine extending to the outside of the housing 2 is connected to an outlet of the drain pump 13.

A water supplier 70 supplying water to the water tub 10 before washing or rinsing is provided in the upper portion of the inside of the housing 2. The water supplier 70 is configured to allow water to flow to the inside of the water tub 10 through an opening of the rotary tub 20 at a predetermined flow rate.

A small box-shaped air chamber 15 is integrally provided on the lower outer side of the peripheral wall of the water tub 10. The air chamber 15 communicates with the inside of the water tub 10 through a communication hole 16 that is opened in a lower corner portion of the water tub 10. A lower end portion of a sub hose 17, which extends along the peripheral wall of the water tub 10 in the vertical direction, is connected to the upper portion of the air chamber 15. A water level sensor 18 is connected to the upper end of the sub hose 17. The water level sensor 18 and the air chamber 15 are connected through the sub hose 17.

Therefore, when water is supplied to the inside of the water tub 10 from the water supplier 70, some of the water also flows into the air chamber 15 through the communication hole 16. When the water level of the water tub 10 rises or falls, the water pressure of the water stored in the water tub 10 also changes and thus the air pressure of the air chamber 15 also increases or decreases. The water level sensor 18 outputs an oscillation frequency in accordance with the change of the atmospheric pressure to the controller 60 and the controller 60 senses the water level of the water tub 10 from the oscillation frequency.

A vibration sensor 19 is provided on the back surface of the bottom wall of the water tub 10. The vibration sensor 19 detects the acceleration in the horizontal direction caused by the vibration of the water tub 10.

The controller 60 is provided in the upper side in the housing 2. The controller 60 may include at least one processor. The controller 60 may include hardware such as CPU and memory and software such as control programs, and comprehensively controls the operation of the washing machine.

That is, the controller 60 controls revolutions of the drive motor 30 or the rotation direction switching of the power transmission device 32 according to the control program, and performs each process, such as water supply, washing, intermediate dehydrating, rinsing, discharging water and dehydrating.

As illustrated in FIG. 2, the water level sensor 18, the vibration sensor 19, and a motor sensor 33 are connected to the controller 60, wherein the water level sensor 18, the vibration sensor 19, and the motor sensor 33 correspond to an input device. For example, the motor sensor 33 is configured by a hall sensor. The motor sensor 33 is installed in any position in the circumferential direction of the drive motor 30 and configured to output a rotation signal every one rotation of the drive motor 30. The controller 60 may obtain the rotational position and the rotation period of the drive motor 30 based on a detection value of the motor sensor 33.

An operator 3 corresponding to an input/output device is connected to the controller 60. An operation switch 4 is installed in the operator 3. A notification buzzer 6, the drive motor 30, the drain pump 13 and the water supplier 70 are connected to the controller 60, wherein the notification buzzer 6, the drive motor 30, the drain pump 13 and the water supplier 70 correspond to an output device.

The controller 60 is also provided with a rotation controller 61, a water supply and discharge controller 62, and a waterproof clothing identifier 64.

The rotation controller 61 may control the rotation of the rotary tub 20 and the pulsator 40 by controlling the driving of the drive motor 30. The water supply and discharge controller 62 may regulate water supply and discharge water by controlling an operation of the drain pump 13 and the water supplier 70.

The waterproof clothing identifier 64 may identify the presence or absence of the waterproof clothing Cwp in order to prevent abnormal vibrations during the dehydrating process.

When a user operates the input switch 4 and selects a predetermined operation mode in a state where the laundry C is put in the rotary tub 20, a series of processes such as washing, rinsing, and dehydrating may be started.

When water is supplied from the water supplier 70 to the rotary tub 20 while the drain pump 13 is stopped, a predetermined amount of water based on the laundry C is stored in the water tub 10 and the rotary tub 20. In the washing process, a detergent may also be added to the water. In this state, the rotary tub 20 does not rotate, and the pulsator 40 rotates the forward and reverse direction. Therefore, the laundry C may be alternately stirred together with the water.

When the drain pump 13 is operated after the rinsing process is finished, water may be discharged from the water tub 10. Further, by the rotation controller 61, the rotary tub 20 and the pulsator 40 may be integral with each other and then rotate in the predetermined direction. The rotation of the rotary tub 20 is increased to reach the highest revolutions (dehydrating revolutions) exceeding 1000 rpm, and the rotary tub 20 may rotate at the dehydrating revolutions for a predetermined period of time.

As a result, the water contained in the laundry C may be discharged from the rotary tub 20 through the drain hole 21 by the action of the centrifugal force. The water discharged from the rotary tub 20 may be discharged out of the washing machine through the drain hose 12 and the washing machine outer hose 14.

The dehydrating process may be performed at the end of a series of process. Further, when the washing or rinsing process is repeated in the middle of the series of process according to the operation mode, the intermediate dehydrating process may be performed between each rinsing process and the washing process (herein, the intermediate dehydrating process and dehydrating process are collectively referred to as the dehydrating process).

When the laundry C includes only general laundry that is water-permeable such as underwear and shirts, and sweaters (herein it is referred to as general clothing Cn), water stored in the rotary tub 20 may be discharged to the outside through the general clothing Cn and the drain hole 21, without problems. Therefore, during the dehydrating process, the laundry C may be dehydrated and thus a weight of the laundry C may be reduced. Therefore, although the laundry is significantly concentrated on one side, the balancer 50 may follow the change of the unbalance and thus an abnormal vibration may rarely occur.

However, when some laundry is mixed with the laundry C, wherein the some laundry represent laundry which hardly allows water to pass through or which allows a little water to pass through despite of allowing water to pass through (herein, it is generally referred to as waterproof clothing Cwp), and the waterproof clothing includes clothing which are waterproofed, or water impermeable products (e.g., raincoats or nylon bed covers), it may be difficult to discharge water due to the waterproof clothing Cwp, thereby interrupting discharging water from the rotary tub 20 and thus remaining water may be generated in the rotary tub 20.

Particularly, when the waterproof clothing Cwp is mixed with the laundry C, a state in which water is wrapped by the waterproof clothing Cwp (water saturated state) may occur before the dehydrating process. Water saturated state represents not only a state in which water is fully wrapped, but also a state in which water is not discharged despite of applying the centrifugal force at the dehydrating process. In general, when the waterproof clothing Cwp is present, the water saturated state occurs either large or small. Small amount remaining water may not cause a problem but large amount remaining water may cause a problem.

When the revolutions of the rotary tub 20 is increased in order to perform the dehydrating processing in the rotary tub 20 in which the water-saturated state is generated, the waterproof clothing Cwp and the general clothes Cn in the water-saturated state are pushed to the peripheral wall 20*a* of the rotary tub 20 by the centrifugal force. Therefore, the general clothing Cn is dehydrated and a weight thereof gradually decreases. The general clothing Cn clings to the peripheral wall 20*a* without moving. On the other hand, a weight of the waterproof clothing Cwp is rarely changed, and water inside of the waterproof clothing Cwp is moved to the upper side and thus the waterproof clothing Cwp clings to the peripheral wall 20*a* by the centrifugal force due to the increase of the revolutions.

Accordingly, an unbalance position of the waterproof clothing Cwp and an unbalance position of the general clothing Cn are opposed to each other inside the rotary tub 20. Further, because water in the waterproof clothing Cwp is moved in the vertical direction, the rotary tub 20 and the water tub 10 are largely shaken in a three-dimensional manner and thus the abnormal vibration occurs.

In order to prevent the abnormal vibration caused by the waterproof clothing Cwp in advance, the washing machine 1 may identify the presence or absence of the waterproof clothing Cwp. Based on the identification result, the washing machine 1 may set the dehydrating revolutions.

Hereinafter, the identification process by the waterproof clothing identifier 64 will be described in detail with reference to the flowchart shown in FIG. 3.

Figure 3:
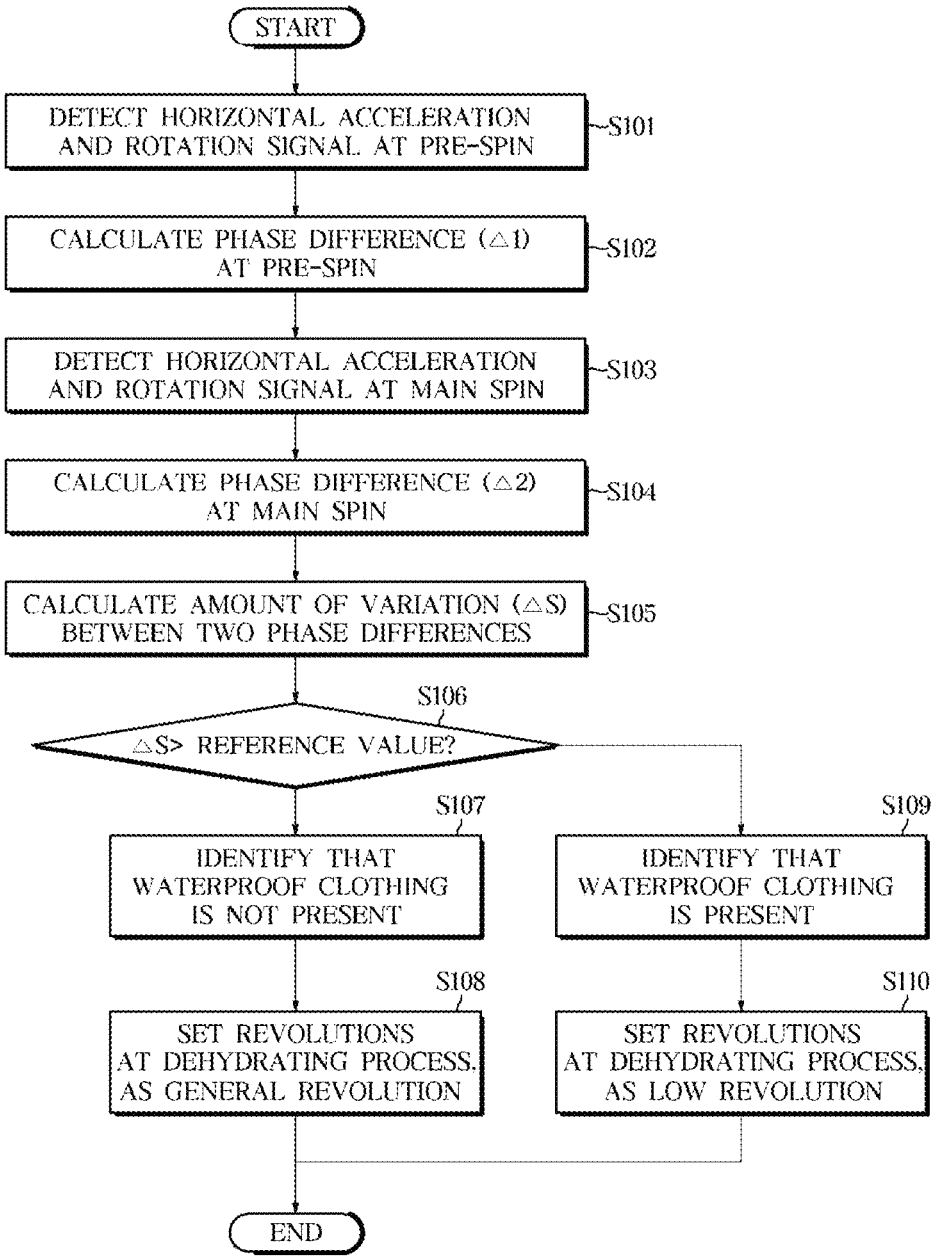
FIG. 3 is a flow chart illustrating an identification process by a waterproof identifier contained in the washing machine according to an embodiment.
Figure 4:
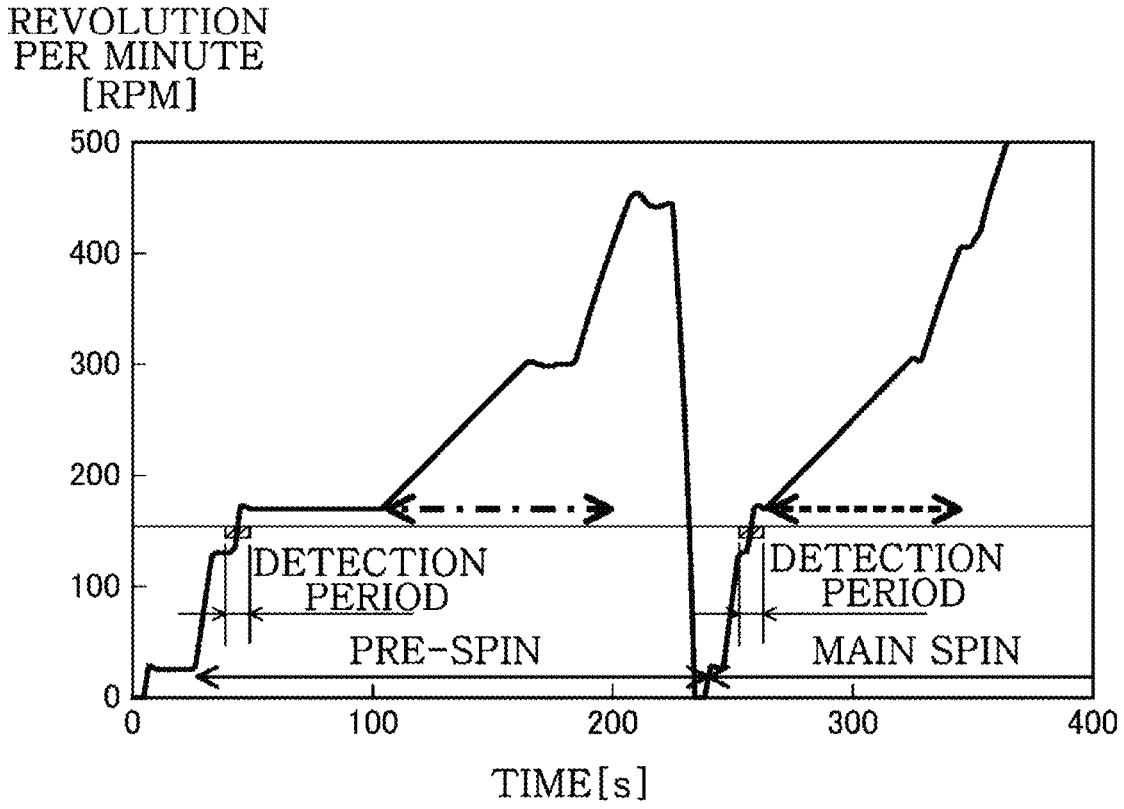
FIG. 4 is a view illustrating two acceleration operations at the start of dehydrating process according to an embodiment.
Figure 5:
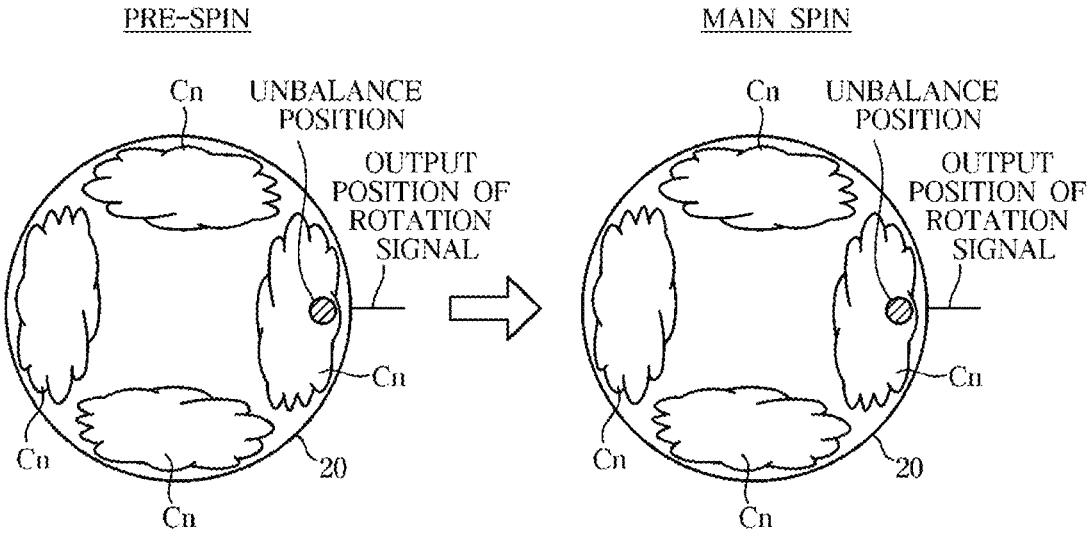
FIG. 5 is a view illustrating an unbalance position of laundry in pre-spin and main spin when only general clothing is placed in the washing machine according to an embodiment.
Figure 6:
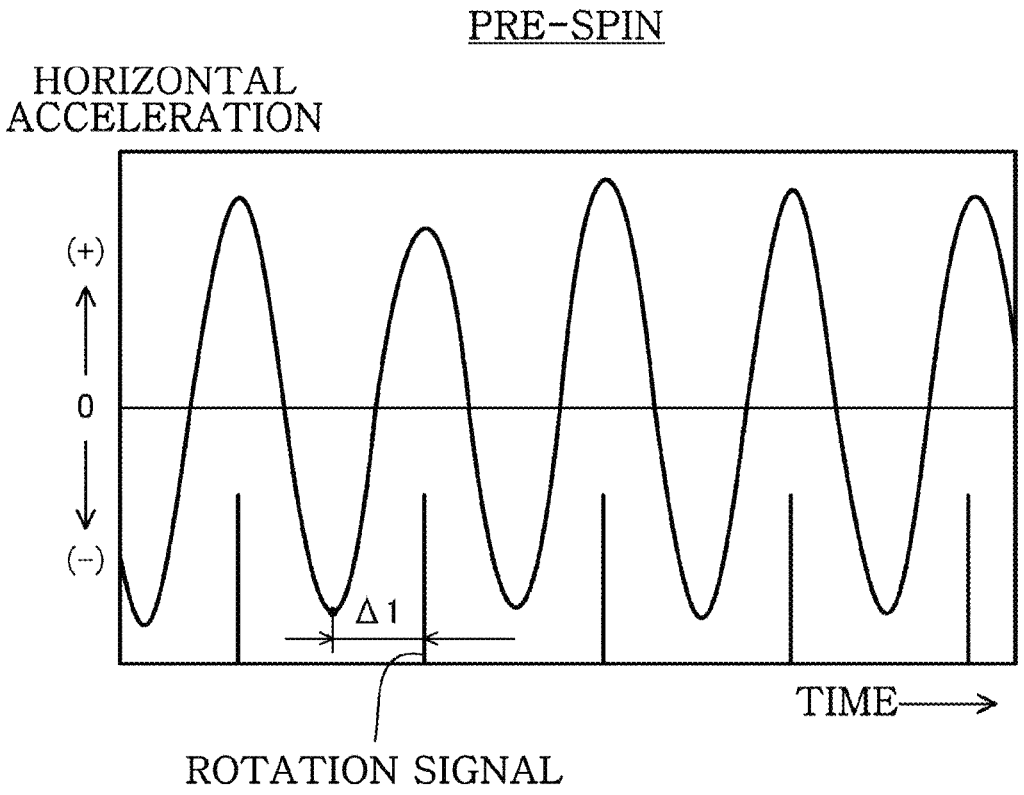
FIG. 6 is a view illustrating a phase difference between a horizontal acceleration of a vibration sensor and a rotation signal of a motor sensor at the pre-spin, when only general clothing is placed in the washing machine according to an embodiment.
Figure 7:
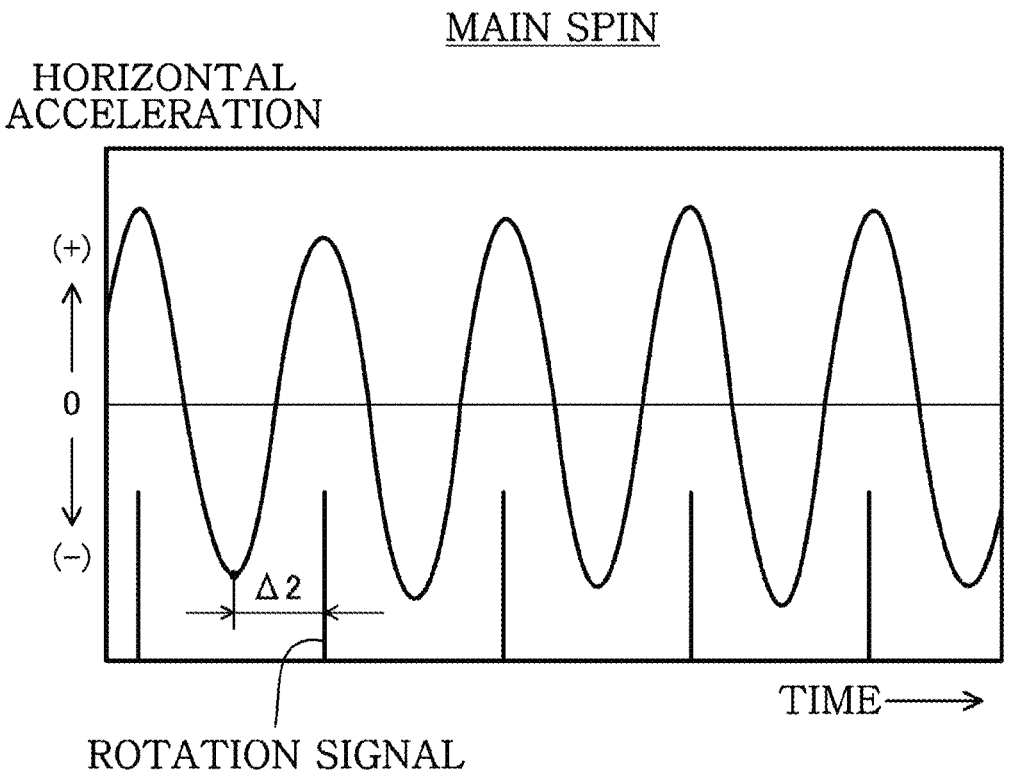
FIG. 7 is a view illustrating a phase difference between a horizontal acceleration of the vibration sensor and a rotation signal of the motor sensor at the main spin, when only general clothing is placed in the washing machine according to an embodiment.
Figure 8:
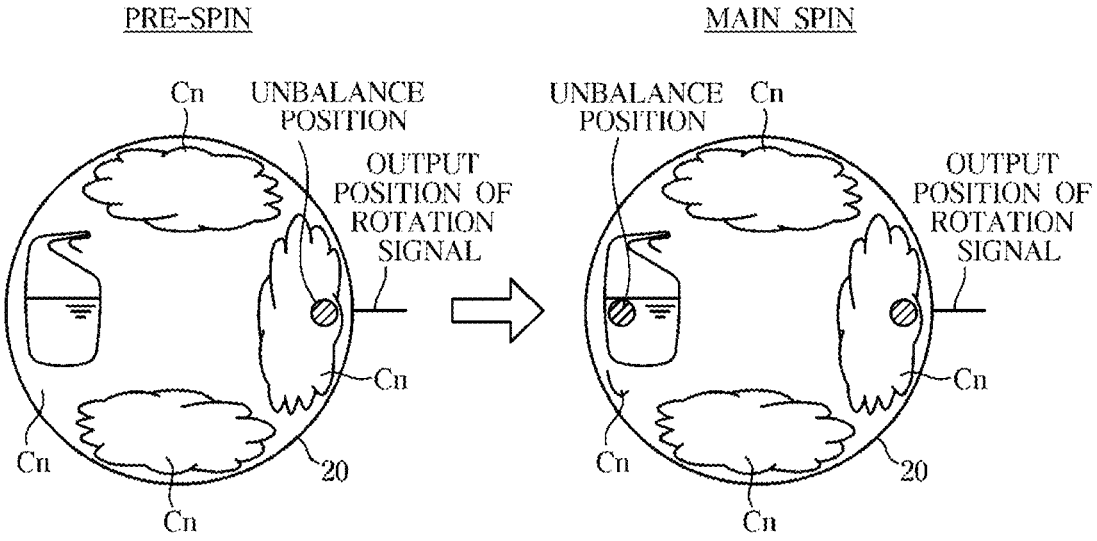
FIG. 8 is a view illustrating an unbalance position of laundry in the pre-spin and the main spin when waterproof clothing is mixed in the washing machine according to an embodiment.
Figure 9:
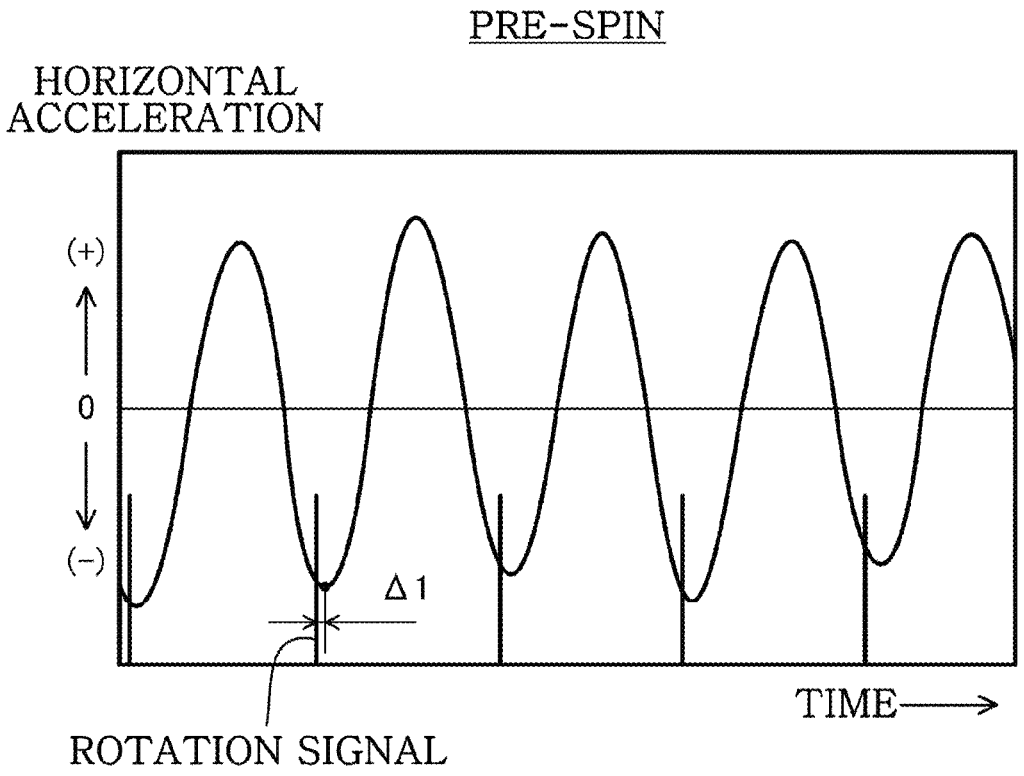
FIG. 9 is a view illustrating a phase difference between a horizontal acceleration of the vibration sensor and a rotation signal of the motor sensor at the pre-spin, when the waterproof clothing is mixed in the washing machine according to an embodiment.
Figure 10:
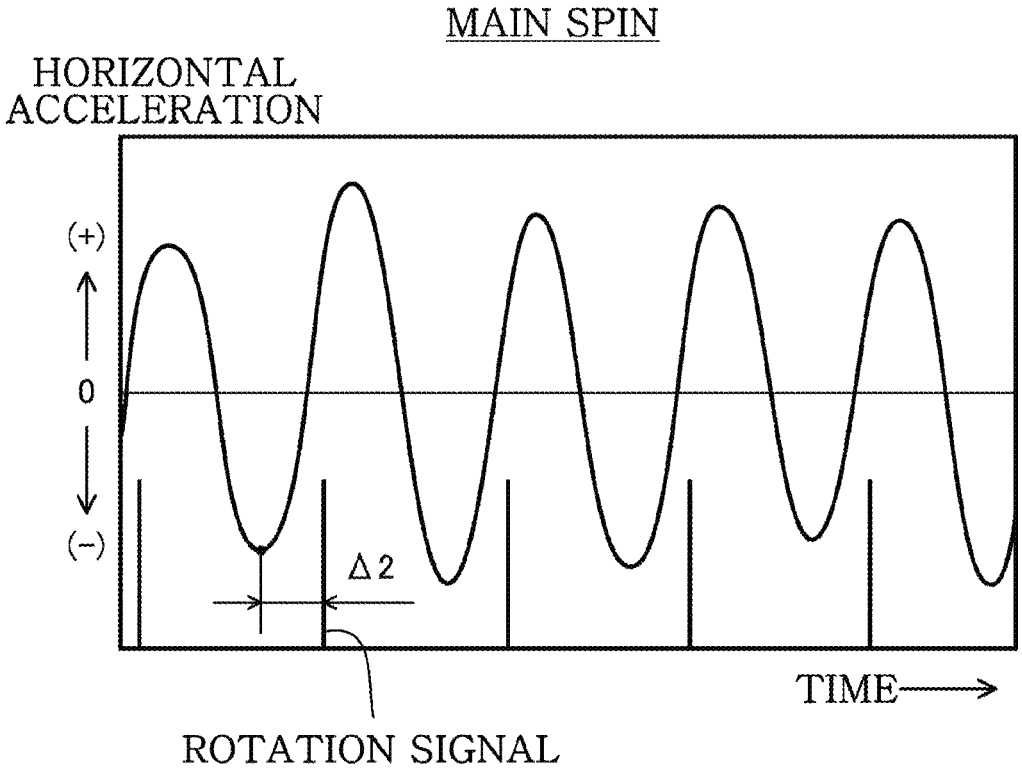
FIG. 10 is a view illustrating a phase difference between a horizontal acceleration of the vibration sensor and a rotation signal of the motor sensor at the main spin, when the waterproof clothing is mixed in the washing machine according to an embodiment.

FIG. 3 is a flow chart illustrating an identification process by a waterproof identifier contained in the washing machine according to an embodiment. FIG. 4 is a view illustrating two acceleration operations at the start of dehydrating process according to an embodiment. FIG. 5 is a view illustrating an unbalance position of laundry in pre-spin and main spin when only general clothing is placed in the washing machine according to an embodiment. FIG. 6 is a view illustrating a phase difference between a horizontal acceleration of a vibration sensor and a rotation signal of a motor sensor at the pre-spin, when only general clothing is placed in the washing machine according to an embodiment. FIG. 7 is a view illustrating a phase difference between a horizontal acceleration of the vibration sensor and a rotation signal of the motor sensor at the main spin, when only general clothing is placed in the washing machine according to an embodiment. FIG. 8 is a view illustrating an unbalance position of laundry in the pre-spin and the main spin when waterproof clothing is mixed in the washing machine according to an embodiment. FIG. 9 is a view illustrating a phase difference between a horizontal acceleration of the vibration sensor and a rotation signal of the motor sensor at the pre-spin, when the waterproof clothing is mixed in the washing machine according to an embodiment. FIG. 10 is a view illustrating a phase difference between a horizontal acceleration of the vibration sensor and a rotation signal of the motor sensor at the main spin, when the waterproof clothing is mixed in the washing machine according to an embodiment.

At the start of the dehydrating process, the washing machine 1 performs an acceleration operation, in which the rotation of the rotary tub 20 is accelerated, by two times, at a low rotation range (e.g., 500 rmp or less) in which the abnormal vibration does not occur although the waterproof clothing Cwp is mixed. The washing machine 1 may identify the presence or absence of the waterproof clothing Cwp by identifying a change in the unbalance position of the laundry C at two times of acceleration operation.

As illustrated in FIG. 4, at the start of the dehydrating process, the rotation controller 61 performs a rotation control (pre-spin) in which a rotation is accelerated to a predetermined revolution, before performing a rotation control (main spin) of the rotary tub 20 at the general dehydrating process in which the rotation is driven until the dehydrating revolutions.

At each acceleration operation of the main spin and the pre-spin, the acceleration in the horizontal direction is detected by the vibration sensor 19, and the rotation signal of the drive motor 30 is detected by the motor sensor 33 at the same revolutions range (a hatching part of FIG. 4) in which the acceleration state is the same. Accordingly, by setting a detection interval before the second resonance occurs in the washing machine 1, it is possible to apply it regardless of the kind of the balancer 50 (fluid balancer or ball balancer).

As illustrated in FIG. 5, when the laundry C includes only the general clothing Cn, a weight of laundry C is reduced as much as a weight of water that is discharged from the general clothing Cn, and thus the change in the unbalance amount and the unbalance position is small at the second acceleration operation (main spin), in comparison with the first acceleration operation (pre-spin).

FIG. 6 illustrates an example of a horizontal acceleration detected by the vibration sensor 19 and a rotation signal detected by the motor sensor at the pre-spin. At the pre-spin, a horizontal acceleration is detected by the vibration sensor 19 and a rotation signal is detected by the motor sensor 33 (S101).

As illustrated in FIG. 6, the horizontal acceleration has positive (+) and negative (−) values at regular intervals. FIG. 6 illustrates a graph with conditions that a stop position of the water tub 10 is zero (0), a vibration in one side of the horizontal direction is an acceleration in a positive (+) direction and a vibration in the other side of the horizontal direction is an acceleration in a negative (−) direction. The rotation signal of the motor sensor 33 is periodically output every rotation of the drive motor 30.

The waterproof clothing identifier 64 calculates a phase difference (Δ1) between a phase of the horizontal acceleration detected by the vibration sensor 19 and a phase of the rotation signal detected by the motor sensor 33 (S102), wherein the phase difference is a parameter indicating that how an unbalance position, which is caused by the concentration of the laundry C, is changed. In FIG. 6, the waterproof clothing identifier 64 calculates a phase difference between a negative peak position of the horizontal acceleration and an output position of the rotation signal.

As illustrated in FIG. 7, during the main spin, the horizontal acceleration is detected by the vibration sensor 19, and the rotation signal is detected by the motor sensor 33 (S103). The waterproof clothing identifier 64 calculates a phase difference (Δ2) between the phase of the horizontal acceleration detected by the vibration sensor 19 and the phase of the rotation signal detected by the motor sensor 33 (S104).

The waterproof clothing identifier 64 calculates an amount of variation between the calculated two phase differences (ΔS) (=Δ2−Δ1) every two times of acceleration operation (S105). In the waterproof clothing identifier 64, a reference value is preset, wherein the reference value is configured to identify the presence or absence of the waterproof clothing Cwp by being compared with the variation amount (ΔS) of the phase difference. The reference value may be obtained by an experiment, and may be appropriately changed depending on the type and size of the washing machine and the operation mode.

The waterproof clothing identifier 64 identifies whether the amount of variation (ΔS) between the two phase differences is greater than the reference value (S106).

As mentioned above, when the laundry C includes only the general clothing Cn, all the laundry C, which is placed in the rotary tub 20 is uniformly dehydrated. That is, there is not much change between the unbalance position of the laundry C in the first acceleration operation (pre-spin) and the unbalance position of the laundry C in the second acceleration operation (main spin).

Therefore, there not much change between the phase difference (Δ1) between the phase of the horizontal acceleration and the phase of the rotation signal at the pre-spin, and the phase difference (Δ2) between the phase of the horizontal acceleration and the phase of the rotation signal at the main spin. That is, the amount of variation (ΔS) between the two phase differences is a value close to zero (0).

Accordingly, the waterproof clothing identifier 64 identifies the above mentioned case as a case in which the variation amount of the phase difference (ΔS) is less than the reference value that is a case in which the waterproof clothing Cwp is not mixed (S107). When the waterproof clothing identifier 64 identifies that the waterproof clothing Cwp is not mixed, the rotation controller 61 controls the operation of the drive motor 30 so that the dehydrating revolutions of the rotary tub 20 is maintained at a general revolution (e.g., 1000 rpm) (S108).

As illustrated in FIG. 8, when the waterproof clothing Cwp is mixed in the laundry C, the side of the general clothing Cn is heavy at the first acceleration operation (pre-spin) since the general clothing Cn in the rotary tub 20 contains sufficient water. At the second acceleration operation (main spin), the general clothing Cn becomes lighter due to the dehydrating, but the waterproof clothing Cwp is not dehydrated and thus water is still remaining in the waterproof clothing Cwp. That is, a large difference occurs between the unbalance position of the laundry C at the pre-spin and the unbalance position of the laundry C at the main spin.

FIG. 9 illustrates an example of a horizontal acceleration detected by the vibration sensor 19 and a rotation signal detected by the motor sensor at the pre-spin when the waterproof clothing Cwp is mixed. At the pre-spin, a horizontal acceleration is detected by the vibration sensor 19 and a rotation signal is detected by the motor sensor 33 (S101).

As illustrated in FIG. 9, the waterproof clothing identifier 64 calculates a phase difference (Δ1) between a phase of the horizontal acceleration detected by the vibration sensor 19 and a phase of the rotation signal detected by the motor sensor 33 at the pre-spin (S102). In FIG. 9, the waterproof clothing identifier 64 calculates a phase difference between a negative peak position of the horizontal acceleration and an output position of the rotation signal.

As illustrated in FIG. 10, during the main spin, the horizontal acceleration is detected by the vibration sensor 19, and the rotation signal is detected by the motor sensor 33 (S103). The waterproof clothing identifier 64 calculates a phase difference (Δ2) between the phase of the horizontal acceleration detected by the vibration sensor 19 and the phase of the rotation signal detected by the motor sensor 33 (S104).

The waterproof clothing identifier 64 calculates an amount of variation between the calculated two phase differences (ΔS) (=Δ2−Δ1) every two times of acceleration operation (S105). The waterproof clothing identifier 64 identifies whether the amount of variation (ΔS) between the two phase differences is greater than the reference value (S106)

As mentioned above, when the waterproof clothing Cwp is mixed in the laundry C, the unbalance position of the laundry C at the pre-spin is placed in the side of the general clothing Cn, but the unbalance position of the laundry C at the main spin is placed in the side of the waterproof clothing Cwp.

Accordingly, there is a large change between the phase difference (Δ1) between the phase of the horizontal acceleration and the phase of the rotation signal at the time of pre-spin, and the phase difference (Δ2) between the phase of the horizontal acceleration and the phase of the rotation signal at the main spin.

Therefore, the waterproof clothing identifier 64 identifies the above mentioned case as a case in which the variation amount of the phase difference (ΔS) is greater than the reference value that is a case in which the waterproof clothing Cwp is mixed (S109). When the waterproof clothing identifier 64 identifies that the waterproof clothing Cwp is mixed, the rotation controller 61 controls the operation of the drive motor 30 so that the dehydrating revolutions of the rotary tub 20 is a predetermined low revolution (e.g., 300 rpm) (S110).

Therefore, while preventing the abnormal vibration caused by the waterproof clothing Cwp, at the time of dehydrating process, the washing machine 1 may complete the dehydrating process without stopping the driving.

In addition, when it is identified that the waterproof clothing Cwp is mixed, the washing machine 1 gives an alter to a notification buzzer 6, and displays an error message on a display panel of the operator 3, thereby calling the attention of the user.

Further, when it is identified that the waterproof clothing Cwp is mixed, the washing machine 1 terminates the driving at the stage and notifies that the user confirms it and restarts the driving.

The above-described embodiment may be configured as follows.

The washing machine 1 may perform the two times of acceleration operation, and identify the presence or absence of the waterproof clothing Cwp by comparing the amount of variation between the calculated two phase differences, with the reference value. In addition, for example, the washing machine 1 may perform the acceleration operation by a plurality of times and obtain an amount of variation between a phase difference after the second time and a phase difference of the first time, by a plurality of times.

As mentioned above, the washing machine 1 may appropriately identify the presence or absence of the waterproof clothing, which is very useful and has high industrial applicability.

As mentioned above, the washing machine may include the rotary tub in which the laundry is placed, the water tub in which the rotary tub is placed and the drive motor rotating the rotary tub, and the washing machine may perform the dehydrating process of the laundry by the rotation of the rotary tub.

The washing machine may include the vibration sensor detecting the acceleration in the horizontal direction caused by the vibration of the water tub, the motor sensor detecting the rotation signal of the drive motor, and the rotation controller controlling the rotation operation of the drive motor. At the start of the dehydrating process, the rotation controller may control the operation of the drive motor to perform the two times of acceleration operation in which the rotation of the rotary tub is accelerated at the low rotation range that is lower than the predetermined revolutions. The vibration sensor and the motor sensor may detect the acceleration and the rotation signal based on the two times of acceleration operation.

At the start of the dehydrating process, the washing machine may perform the two times of acceleration operation in which the rotation of the rotary tub is accelerated, at the low rotation range, in which the abnormal vibration does not occur although the waterproof clothing is mixed. The washing machine may detect the acceleration by using the vibration sensor and detect the rotation signal by using the motor sensor at the two times of acceleration operation.

When the waterproof clothing is mixed or when the waterproof clothing is not mixed, the washing machine may identify the presence or absence of the waterproof clothing, with high accuracy, by identifying the change of the unbalance position of the laundry based on the two times of acceleration operation. Therefore, the washing machine may allow the vibration sensor to detect the acceleration and the motor sensor to detect the rotation signal, wherein the acceleration and the rotation signal correspond to a parameter configured to identify the change of the unbalance position.

The vibration sensor and the motor sensor may detect the acceleration and the rotation signal at a predetermined same revolutions range of the two times of acceleration operation.

The washing machine may detect the acceleration by using the vibration sensor and detect the rotation signal by using the motor sensor at the predetermined same revolutions range of the two times of acceleration operation. Accordingly, by identifying the change of the unbalance position of the laundry at the same revolutions range of the two times of acceleration operation, the washing machine may identify the presence or absence of the waterproof clothing, with high accuracy.

The washing machine may further include a waterproof clothing identifier identifying whether the waterproof clothing is present in the laundry, based on the detection value of the vibration sensor and the detection value of the motor sensor.

The washing machine may identify the presence or absence of the waterproof clothing based on the detection value of the vibration sensor and the detection value of the motor sensor. Accordingly, the washing machine may prevent the abnormal vibration at the dehydrating process caused by the waterproof clothing in advance.

The waterproof clothing identifier may calculate a phase difference between a phase of the acceleration detected by the vibration sensor and a phase of the rotation signal detected by the motor sensor.

The washing machine may calculate a phase difference between a phase of the acceleration detected by the vibration sensor and a phase of the rotation signal detected by the motor sensor. Therefore, the washing machine may identify how the unbalance position, which is caused by the concentration of the laundry, is changed in the two times of acceleration operation.

The waterproof clothing identifier may identify the presence or absence of the waterproof clothing by comparing the amount of the variation between two phase differences, which is calculated every acceleration operation, with the predetermined reference value.

The washing machine may identify the presence or absence of the waterproof clothing by comparing the amount of the variation between two phase differences, which is calculated at the two times of acceleration operation, with the predetermined reference value.

Particularly, when the waterproof clothing is not mixed in the laundry, all laundry contained in the rotary tub is dehydrated evenly. That is, there is not a great change between the unbalance position and amount of the laundry in the first acceleration operation and the unbalance position and amount of the laundry in the second acceleration operation. Accordingly, the amount of the variation between two phase differences, which is calculated every acceleration operation, does not exceed the predetermined reference value.

Although the unbalance amount in the first acceleration operation is small and the unbalance amount in the second acceleration operation is small, a case in which the variation amount of phase difference has a large value may occur, but a case in which the unbalance amount and position is greatly changed at the same time may rarely occur. Therefore, the acceleration may greater than the predetermined reference value and at the same time, the variation amount of the phase difference may not exceed the predetermined reference value.

Meanwhile, when the waterproof clothing is mixed in the laundry, the side of the general clothing is heavy at the first acceleration operation, since sufficient amount water is contained in the general clothing in the rotary tub. However, at second acceleration operation, the general clothing is dehydrated and then becomes lighter but the waterproof clothing is not dehydrated and thus still water is remaining in the waterproof clothing. That is, there is a great change between the unbalance position and amount of the laundry in the first acceleration operation and the unbalance position and amount of the laundry in the second acceleration operation. Accordingly, the amount of the variation between two phase differences, which is calculated every acceleration operation, exceeds the predetermined reference value and thus the acceleration also becomes large.

The waterproof clothing identifier may identify the presence or absence of the waterproof clothing with high accuracy by comparing the amount of the variation between two phase differences, which is calculated every acceleration operation, with the predetermined reference value.

When the waterproof clothing identifier identifies that the waterproof clothing is present, the rotation controller may control the operation of the drive motor so that the rotary tub is rotated at the predetermined revolutions or less at the dehydrating process.

When it is identified that the waterproof clothing is contained in the laundry, the washing machine may allow the rotary tub to be rotated at the predetermined revolutions or less at the dehydrating process. Particularly, when it is identified that the waterproof clothing is accommodated in the rotary tub in a state in which the maximum revolutions of the rotary tub is set to about 1000 rpm in the general dehydrating process, the maximum revolutions of the rotary tub in the dehydrating process may be set to about 300 rpm.

Accordingly, the washing machine may prevent the abnormal vibration, which is caused by the waterproof clothing containing water, at the dehydrating process and the washing machine may complete the dehydrating process without stopping the driving.

As apparent from the above description, according to the proposed washing machine and control method thereof, it is possible to appropriately identify the presence or absence of the waterproof clothing.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Various embodiments of the present disclosure have been described above. In the embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described embodiments, embodiments can thus be implemented through computer readable code/instructions in/on a medium, e.g., a computer readable medium, to control at least one processing element to implement any above described embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

Although the present disclosure has been described with various embodiments, various changes and modifications may be suggested to one skilled in the art. It is intended that the present disclosure encompass such changes and modifications as fall within the scope of the appended claims.

What is claimed is:

1. A washing machine comprising:

a cabinet;

an outer tub elastically supported on an inside of the cabinet;

an inner tub provided inside of the outer tub and configured to rotate;

a motor configured to rotate the inner tub;

a vibration sensor provided in the outer tub;

a rotation sensor provided in the motor; and at least one processor electrically connected to the vibration sensor, the rotation sensor, and the motor and configured to control a rotation speed of the motor based on a variation between a first calculated phase difference and a second calculated phase difference of a phase difference between a phase of a vibration of the outer tub detected by the vibration sensor and a phase of a rotation of the motor detected by the rotation sensor.

2. The washing machine of claim 1, wherein the at least one processor is configured to:

receive a vibration signal indicating the vibration of the outer tub from the vibration sensor, and receive a rotation signal indicating the rotation of the motor from the rotation sensor, wherein the phase difference between a phase of a vibration of the outer tub detected by the vibration sensor and a phase of a rotation of the motor detected by the rotation sensor is determined between the vibration signal and the rotation signal.

3. The washing machine of claim 2, wherein the at least one processor is configured to:

rotate the motor at a first rotation speed based on the variation between the first calculated phase difference and the second calculated phase difference being less than a reference value, and rotate the motor at a second rotation speed, which is less than the first rotation speed, based on the variation between the first calculated phase difference and the second calculated phase difference being equal to or greater than the reference value.

4. The washing machine of claim 1, wherein, at a dehydrating operation, the at least one processor is configured to:

perform a pre-spin acceleration of the motor to a first dehydrating speed, and perform a main spin acceleration of the motor to a second dehydrating speed that is greater than a first rotation speed.

5. The washing machine of claim 4, wherein the at least one processor is configured to:

receive a first vibration signal from the vibration sensor and a first rotation signal from the rotation sensor in response to the rotation speed of the motor reaching a detection speed during the pre-spin acceleration, and receive a second vibration signal from the vibration sensor and a second rotation signal from the rotation sensor in response to the rotation speed of the motor reaching a detection speed during the main spin.

6. The washing machine of claim 5, wherein the at least one processor is configured to control the rotation speed of the motor based on (i) a first phase difference indicating a phase difference between the first vibration signal and the first rotation signal and (ii) a second phase difference indicating a phase difference between the second vibration signal and the second rotation signal.

7. The washing machine of claim 6, wherein the at least one processor is configured to:

rotate the motor at the first rotation speed based on a difference between the first phase difference and the second phase difference being less than a reference value, and rotate the motor at a second rotation speed, which is less than the first rotation speed, based on the difference between the first phase difference and the second phase difference being equal to or greater than the reference value.

8. A control method of a washing machine comprising a cabinet, the control method comprising:

detecting a vibration of an outer tub elastically supported on an inside of the cabinet, by a vibration sensor provided in the outer tub;

detecting a rotation of a motor configured to rotate an inner tub provided inside of the outer tub, by a rotation sensor provided in the motor; and controlling a rotation speed of the motor based on a variation between a first calculated phase difference and a second calculated phase difference of a phase difference between a phase of the vibration of the outer tub and a phase of the rotation of the motor.

9. The control method of claim 8, wherein the phase difference between a phase of the vibration of the outer tub and a phase of the rotation of the motor is determined between (i) a vibration signal indicating the vibration of the outer tub and (ii) a rotation signal indicating the rotation of the motor.

10. The control method of claim 9, wherein controlling the rotation speed of the motor based on a variation between a first calculated phase difference and a second calculated phase difference comprises:

rotating the motor at a first rotation speed based on the variation between the first calculated phase difference and the second calculated phase difference being less than a reference value; and rotating the motor at a second rotation speed, which is less than the first rotation speed, based on the variation of the first calculated phase difference and the second calculated phase difference being equal to or greater than the reference value.

11. The control method of claim 8, further comprising, at a dehydrating operation:

performing a pre-spin acceleration of the motor to a first dehydrating speed, and performing a main spin acceleration of the motor to a second dehydrating speed that is greater than a first rotation speed.

12. The control method of claim 11, further comprising:

obtaining a first vibration signal indicating the vibration of the outer tub and a first rotation signal indicating the rotation of the motor in response to the rotation speed of the motor reaching a detection speed during the pre-spin acceleration; and obtaining a second vibration signal indicating the vibration of the outer tub and a second rotation signal indicating the rotation of the motor in response to the rotation speed of the motor reaching a detection speed during the main spin.

13. The control method of claim 12, wherein controlling the rotation speed of the motor based on the vibration of the outer tub and the rotation of the motor comprises controlling the rotation speed of the motor based on (i) a first phase difference indicating a phase difference between the first vibration signal and the first rotation signal and (ii) a second phase difference indicating a phase difference between the second vibration signal and the second rotation signal.

14. The control method of claim 13, wherein the controlling of the rotation speed of the motor based on the first phase difference and the second phase difference comprises:

rotating the motor at the first rotation speed based on a difference between the first phase difference and the second phase difference being less than a reference value, and rotating the motor at a second rotation speed, which is less than the first rotation speed, based on the difference between the first phase difference and the second phase difference being equal to or greater than the reference value.

15. A washing machine, comprising:

a water tub;

a rotary tub, within the water tub, to accommodate laundry;

a drive motor configured to rotate the rotary tub and perform a dehydrating process of laundry upon rotation of the rotary tub;

a vibration sensor configured to detect an acceleration in a horizontal direction caused by a vibration of the water tub;

a motor sensor configured to detect a rotation signal of the drive motor; and at least one processor configured to:

control a rotation operation of the drive motor based on a variation between a first calculated phase difference and a second calculated phase difference of a phase difference between a phase of the acceleration detected by the vibration sensor and a phase of the rotation signal detected by the motor sensor, and at a start of the dehydrating process, control the drive motor to perform two acceleration operations in which the rotation of the rotary tub is accelerated at a low rotation range below a predetermined number of revolutions, wherein the vibration sensor and the motor sensor are configured to detect the acceleration and the rotation signal, respectively, at each of the two acceleration operations.

16. The washing machine of claim 15, wherein the vibration sensor and the motor sensor are configured to detect the acceleration and the rotation signal, respectively, at a predetermined same revolution per minute (rpm) range of the two acceleration operations.

17. The washing machine of claim 15, wherein the at least one processor is further configured to identify whether waterproof clothing is present in the laundry based on a detection value of the vibration sensor and a detection value of the motor sensor.

18. The washing machine of claim 17, wherein the at least one processor is configured to identify a presence or absence of the waterproof clothing by comparing an amount of the variation of the first calculated phase difference and the second calculated phase difference between the phase of the acceleration and the phase of the rotation signal, which are respectively calculated at the acceleration operations, with a predetermined reference value.

19. The washing machine of claim 17, wherein, based on the at least one processor identifying that the waterproof clothing is present, the at least one processor is configured to control the drive motor to rotate the rotary tub at a predetermined rpm or less at the dehydrating process.

* * * * *